US005480681A

United States Patent [19]

VerMehren

[11] Patent Number: 5,480,681

[45] Date of Patent: Jan. 2, 1996

[54] METHOD OF COATING WITH A GUMMER ROLL APPARATUS

[76] Inventor: H. Richard VerMehren, 3865 N. Palafox St., Pensacola, Fla. 32505

[21] Appl. No.: 850,428

[22] Filed: Mar. 12, 1992

Related U.S. Application Data

[63] Continuation-in-part of Ser. No. 494,679, Mar. 16, 1990, abandoned.

[51] Int. Cl.[6] ..... B05D 1/28

[52] U.S. Cl. ..... 427/428; 118/249; 118/259; 118/262

[58] Field of Search ..... 427/428; 118/249, 118/259, 262

[56] References Cited

U.S. PATENT DOCUMENTS

| | | | |
|---|---|---|---|
| 2,039,335 | 5/1936 | Nall | 270/40 |
| 2,354,825 | 8/1944 | Novick | 93/62 |
| 2,748,675 | 6/1956 | Affelder | 93/62 |
| 2,956,484 | 10/1960 | Subklew | 93/61 |
| 3,285,169 | 11/1966 | Hartwig | 101/207 |
| 3,303,814 | 2/1967 | Nitchie | 118/262 |
| 3,367,249 | 2/1968 | Hornung | 93/61 |
| 3,372,861 | 3/1968 | Johnson et al. | 229/80 |
| 3,400,641 | 9/1968 | Stemmler | 93/61 |
| 3,408,908 | 11/1968 | Berkowitz | 93/61 |
| 3,450,009 | 6/1969 | Dohnalik | 93/62 |
| 3,604,318 | 9/1971 | Winkler | 93/74 |
| 3,768,438 | 10/1973 | Kumpf | 118/262 |
| 3,869,965 | 3/1975 | Howatt | 93/61 A |
| 3,906,844 | 9/1975 | Gougeon | 93/61 B |
| 3,957,570 | 5/1976 | Helm | 156/519 |
| 3,980,006 | 9/1976 | Welch | 93/61 R |
| 3,990,354 | 11/1976 | Ward et al. | 93/62 |
| 4,046,931 | 9/1977 | Innes et al. | 427/428 |
| 4,114,520 | 9/1978 | Achelpohl et al. | 93/33 X |
| 4,126,948 | 11/1978 | VerMehren | 34/150 |
| 4,138,933 | 2/1979 | Helm | 93/61 R |
| 4,160,500 | 7/1979 | VerMehren | 198/457 |
| 4,210,318 | 7/1980 | VerMehren | 270/79 |
| 4,249,984 | 2/1981 | VerMehren | 156/552 |
| 4,257,514 | 3/1981 | VerMehren | 198/459 |
| 4,357,896 | 11/1982 | Feldkamper | 118/262 |
| 4,379,730 | 4/1983 | Anderson | 118/262 |
| 4,443,211 | 4/1984 | Wooley | 493/188 |
| 4,514,182 | 4/1985 | VerMehren | 493/216 |
| 4,624,408 | 11/1986 | VerMehren | 229/69 |
| 4,642,085 | 2/1987 | Helm | 493/222 |
| 5,112,291 | 5/1992 | VerMehren | 493/409 |
| 5,176,611 | 1/1993 | VerMehren | 493/213 |

FOREIGN PATENT DOCUMENTS

| | | | |
|---|---|---|---|
| 878245 | 8/1971 | Canada | 93/14 |
| 216643 | 12/1984 | Germany | 427/428 |

*Primary Examiner*—Shrive Beck
*Assistant Examiner*—Katherine A. Bareford
*Attorney, Agent, or Firm*—Heller & Kepler

[57] ABSTRACT

A gumming roll preferably for use with apparatus for applying gum to blanks and pertains has gear driven rollers and the rollers are in skidding contact for returning excess adhesive to an adhesive pan without substantial foaming of the adhesive. The gumming apparatus speed of operation is greater than the conventional apparatus in which adhesive foaming is a problem.

12 Claims, 6 Drawing Sheets

METHOD OF COATING WITH A GUMMER ROLL APPARATUS

CROSS-REFERENCE TO RELATED APPLICATION

This application is a continuation-in-part of application Ser. No. 494,679, filed Mar. 16,1990, now abandoned.

BACKGROUND OF THE INVENTION

The present invention relates in general to a gumming roll apparatus for applying gum to blanks and pertains, more particularly, to an apparatus for applying gum to envelopes during continuous processing and operation of a gumming machine. The roller combination of this invention is an improvement over the conventional low speed gumming station roller combination.

With the conventional gumming roll apparatus a gumming station is typically one of a number of stations in an envelope processing apparatus or other continuous processing apparatus. For example, it is common to provide a gumming station in a conventional envelope making machine or in apparatus intended to apply gum (e.g., a self-sealing latex adhesive) to envelopes already formed and processed solely for the purpose of applying a desired adhesive.

Self-sealing envelopes typically require cooperating adhesive deposits applied to both a flap and an enclosure portion of an envelope. The envelope is gummed in order that a sealed envelope will be formed when the adhesive carrying portions are pressed together. It will be understood that other articles, forms, or enclosures may be processed in an equivalent manner.

The conventional gumming stations typically satisfy the operational requirements with a combination gum box, roller for transferring the gum or adhesive to one or more gummer pads on a gummer roll. The conventional apparatus includes the gum box or trough for supplying the adhesive of choice, one or more intermediate transfer rollers for transferring the adhesive to the adhesive application roller.

These conventional roller arrangements provide for the physical transfer of the adhesive as rotation of the roller carries the roller surface through the gum box and the adhesive which agitates the adhesive. Typical adhesives, particularly latex adhesives, foam or froth as a consequence of agitation.

It is a known drawback of gumming apparatus that the foam or froth may be transferred on the rollers to the envelope or other adhesive receiving portion of an article processed at the gumming station. The foam or froth creates a blemish on the adhesive which may not provide a desired adherence. It is typical to reject items with this foam or froth blemish. As a result, conventional gumming stations and apparatus have a drawback of a limited speed of operation.

The gumming station speed limitation creates an overall equipment limitation since the transfer roller must operate at a speed sufficient to transfer adhesive to the gumming roller and the latter roller rotates in a manner to provide registration between gummer pads and items passing through the gumming station.

Reducing the rotational speed of a gumming roller without reducing the processing speed or output of the gumming station would require a relatively large gumming roller circumference with a limited rotational speed in conventional apparatus. This solution has numerous drawbacks, including space limitation since the gummer station is often one of a number of stations. Another drawback associated with a larger and slower gumming roller is that the adhesive could dry out between applications of fresh adhesive from the transfer roller.

Accordingly, it is an object of the present invention to provide an improved gum roll apparatus that is adapted to increase the processing speed of a gumming station. With the roller arrangement of this invention the gumming station output of either a stand alone station or a gumming station incorporated into a larger apparatus will be increased without significant adhesive degradation due to foam or froth transferred to a workpiece from the gumming roller.

Another object of the present invention is to provide an improved gum roll apparatus that is constructed to provide a more uniform adhesive transfer with an increase in gum roller rotational speed and thus provide an increased output for an apparatus incorporating the arrangement of this invention.

A further object of the present invention is to provide an improved gum roll apparatus that is adapted for use with existing equipment. The improved roller combination of this invention may be incorporated into existing equipment with only minor timing modifications to ensure that the adhesive is applied in desired registration with the envelope flap, or the like.

Still another object of the present invention is to provide an improved gum roll apparatus that may be readily adapted for use in a gumming machine for applying adhesive to envelope flaps.

Still a further object of the present invention is to provide an improved gum roll apparatus that allows an increase in gummer cylinder rotational speed without a corresponding increase in adhesive foaming. The combination of this invention substantially eliminates adhesive or gum foaming on the gummer cylinder and associated gummer pads.

Another object of the present invention is to provide an improved gum roll apparatus that includes a gear train for matching the speed of the cooperating rollers, including the gum box rolls and the roll applying the adhesive to the workpiece. The gear train can be varied by skilled mechanics in the event that rollers with different diameters are required or selected for operation of the gum box and gum roll apparatus.

A further object of the present invention is to provide an improved gum roll apparatus that is adapted to keep the rollers in a gum box rotating in the event that a main drive mechanism for the envelope manufacturing machine stops or is shut down when the shut down temporary, for example, when an envelope line is changed or a new gumming cylinder gumming pad arrangement is desired. In this manner the gum roller arrangement is kept moving and clean out is not required before start up is again initiated.

SUMMARY OF THE INVENTION

To accomplish the foregoing and other objects of this invention there is provided an gum roll apparatus and gumming roll combination for transferring adhesive from a gum box to a receiving piece, such as an envelope flap. The gum roll apparatus and gumming roll combination comprises an adhesive reservoir means and a plurality of operatively associated transfer means.

A portion of the adhesive means is transferred from the reservoir means to a workpiece. The skidding of one roller on another effectively removes and returns the adhesive to a pan without causing foam or froth in the pan at slow operating speeds and significantly reducing foaming and frothing at relatively higher operating speeds and returns excess adhesive material to the reservoir with a minimum of foaming of the adhesive in the reservoir. The transfer means may include first and second roller means.

Another roller means is in wiping contact with the first roller means. The wiping contact results in the transfer of a non-turbulent portion of the adhesive means from the first roller means to the second roller means.

A third roller means is in operative contact with the adhesive carried on the second roller means. A portion of the adhesive is transferred from the second roller means to the third roller means and then to a designated portion of the receiving piece or workpiece.

A plurality of gears define a gear train. The gear train is driven by an electric motor or its equivalent when the drive mechanism for the gummer cylinder stops or is turned off or otherwise disconnected. The gear train is associated with the rollers for positive drive of the rollers. A gear or gears can be changed to vary the relative speeds between the rollers.

A method of the present invention includes the steps of providing an adhesive means in a container and rotating a first roller means through the adhesive means in the container. A second roller means is rotated in the same direction and skids over the first roller means with the second roller means returning an excess of the adhesive means to an adhesive reservoir with reduced foaming.

In one preferred embodiment a gear train provides the correct rotational speed and direction of the rollers relative to one another. An electric motor may be utilized to provide the rotational motion to the gear train.

These and other objects and features of the present invention will be better understood and appreciated from the following detailed description of one embodiment thereof, selected for purposes of illustration and shown in the accompanying drawings.

DETAILED DESCRIPTION

Figure 1:
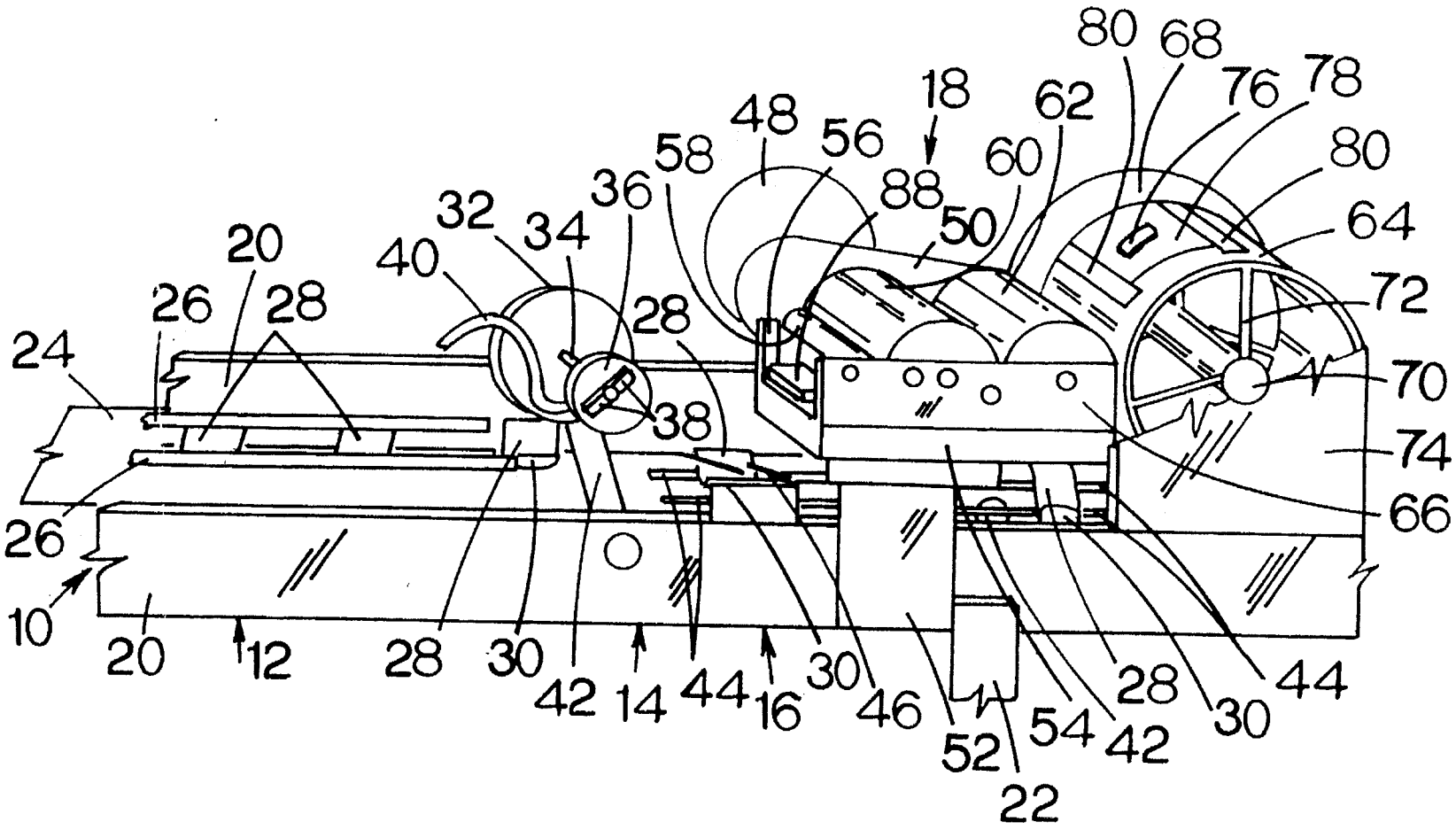
FIG. 1 is a perspective view of a schematic representation of a conventional gumming apparatus incorporating a combination of gumming rolls constructed in accordance with the present invention.

Referring now to the drawings there are shown preferred embodiments for the gum roller and gum roller combination incorporating the meter and skidding or wiping roll of this invention. The wiping roll is described in connection with an envelope making application to apply adhesive to an envelope construction. The wiper roll of the present invention is particularly adapted for providing a homogeneous adhesive layer on the envelope and is characterized by the isolation of foam or froth from the adhesive applied to the envelope.

The drawings show a conventional gumming apparatus 10 including a conveying station 12, a workpiece or envelope transfer station 14, a flap bending station 16, and a gumming station 18. The gumming apparatus includes horizontal supporting framework members 20 and vertical supporting framework members 22.

The workpiece 28, e.g., an envelope is transferred through the gumming apparatus 10 on a conventional conveyor table 24 while it is maintained in a generally flattened position by longitudinal hold down members 26 placed as required along the length of the gumming apparatus. The envelope 28 depicted in FIG. 1 includes a single gum or adhesive receiving flap 30.

The conventional transfer station 14 includes a power take off mechanism and its associated housing 32. The particular power take off will vary depending upon the method used to supply motive power to the various stations along the length of the apparatus 10. A chain drive, belt drive, or individual motors are suitable power sources. It will be understood by one skilled in the art as to how to provide the required power take off to the gumming apparatus stations.

Referring again to the transfer station 14, there is provided the drive or gear housing 32 from which extends a drive shaft 34. A support member 36 at the end of the drive shaft carries two vacuum supply outlets 38 and the vacuum is supplied from a suitable vacuum source (not shown) by a vacuum hose 40. The drive shaft rotates the outlets 38 in timed relationship with the envelopes 28 transferred through the gumming apparatus 10. A plurality of driven and non-driven transfer rollers 42 assist in the transfer and movement of the envelopes.

The transfer station moves each envelope in turn to the flap bending station 16 and into cooperative association with receiving supports 44 which guide each envelope to a flap bending member 46. In the illustrated embodiment a plough share bending device is depicted. In will be understood that other flap bending devices may be substituted.

The gumming station 18 includes a drive or gear housing 48 for the desired power take off arrangement used in a particular gumming apparatus. As will be understood from the support arrangement, the gumming station of the present invention may be removed or added to a particular gumming apparatus. If the present invention is added to an existing apparatus, then those skilled in the art will recognize and understand the timing adjustments that may be required to integrate the gumming station as an operating portion of the overall apparatus.

The drive or gear housing may also include a conventional adjustable drive or gear arrangement in order to adjust the rotational speed of the rollers (described below). Incorporation of an adjustable drive increases the flexibility of the gumming station to accommodate different operating requirements that the apparatus 10 is intended to provide.

A gear housing 50 is provided and supported on a framework that permits removal of the entire gummer station as a unit, if desired. The framework includes vertical support members 52 and horizontal support members 54. A housing support member 56 is shown for the illustrated embodiment.

The roller combination in the illustrated embodiment includes a gum (gum and adhesive are used interchangeably throughout) metering roller 58, a gum roller 60, a wiper roller 62, and a gummer cylinder 64. A roller support structure 66 provides shaft and bearing support for the rollers as required.

A gummer cylinder drive or gear housing 68 is provided for the gear, drive, or power take off arrangement provided with the particular gummer apparatus 10. In one of the illustrated embodiment, FIG. 1 and 2, a chain drive (not shown) is provided, extending the length of the apparatus 10. The chain will provide the source of power for drives at each station.

The conventional gummer cylinder 64 includes a drive shaft 70, spoke members 72 (the spokes may not be required if the cylinder is constructed from a hollow cylinder with closed ends, not shown), and the gummer cylinder support surface or structure 74. The structure 74 carries a conventional gummer pad 76 and a flexible support sheet 78.

The flexible sheet 78 is typically held in place with strips of tape 80. Using tape allows the pads to be moved or changed. For example, it will be noted that one gummer pad 76 is used in FIG. 1 and two gummer pads 118 and 120 are used in the embodiment depicted in FIG. 2 because of the different envelope being processed.

Figure 2:
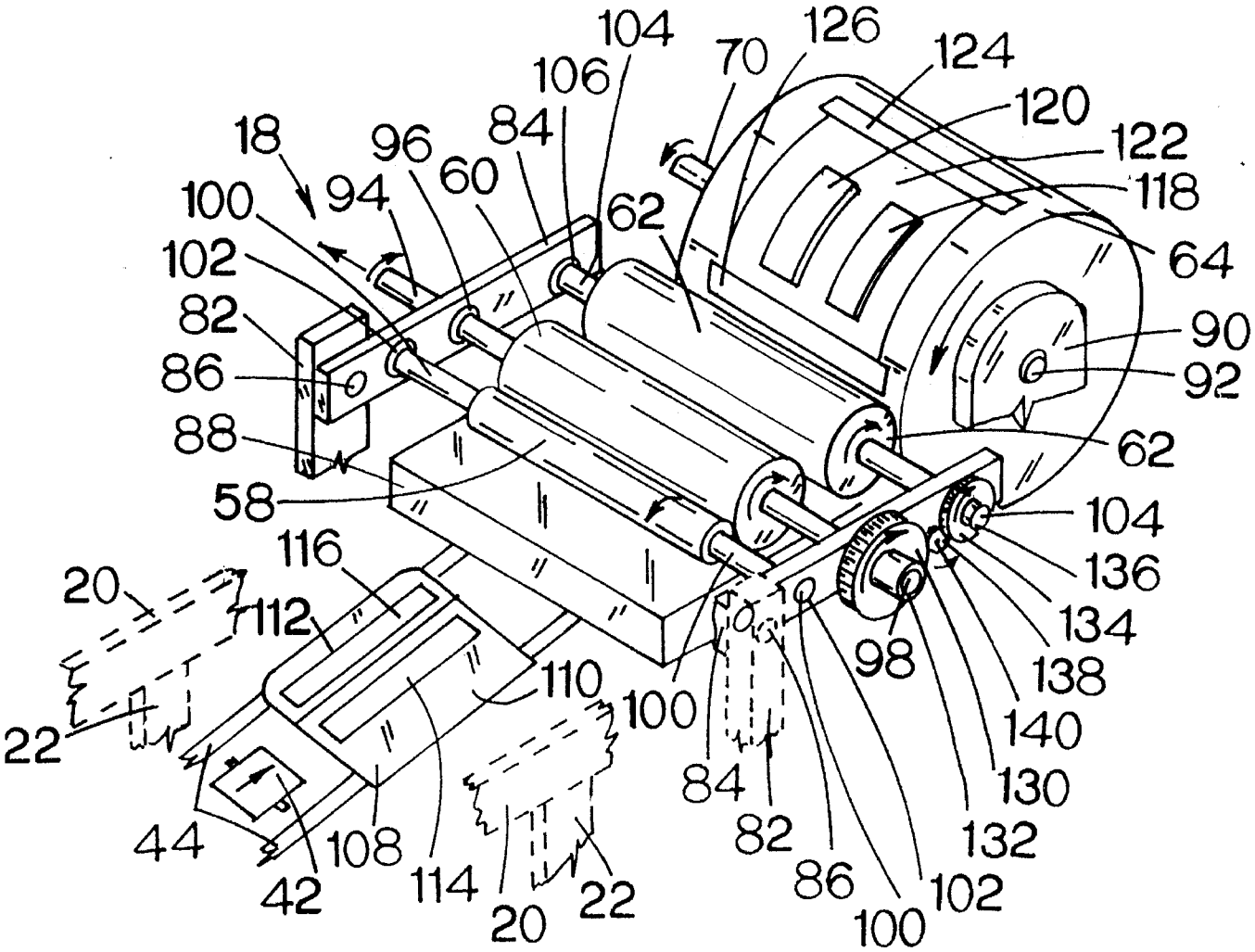
FIG. 2 is a perspective view of another schematic representation of a gumming roll combination incorporating a metering and wiping roll.

Another embodiment of the present invention is depicted in FIG. 2 and includes gummer station 18 and associated vertical support members 82 and horizontal support members 84. The horizontal members 84 can incorporate the required bearing supports for the roller support shafts. Suitable fasteners 86, such as machine bolts, hold the structure together and may be removed as required. The support structure supports an adhesive pan 88.

A gummer roll support structure 90 including necessary bearings 92 provide support for the gummer cylinder 64.

The gum and wiper roller combination 60, 62 are driven through a gum roller drive shaft 94 supported for rotation by a suitable shaft bearing 96. A shaft extension 98 extends to the support member 84. The metering roller 58 is supported for rotation by support shaft 100 and associated support shaft bearings 102. Similarly, the wiper roller 62 is supported for rotation by its associated support shaft 104 and support shaft bearing 106. Both the wiper and meter rollers are eccentrically mounted in this embodiment.

In this embodiment, the gum and meter roller combination 60, 58 are driven through the gum roller drive shaft 94 supported for rotation by the shaft bearing 96.

Another workpiece 108 is illustrated and includes an enclosure portion 110 and a flap portion 112. The enclosure is illustrated as having an adhesive receiving portion 114 and the flap has an adhesive receiving portion 116. This illustrates the flexibility provided by the gummer pads that can be removed and replaced. In FIG. 2 there is shown an enclosure gummer pad 118 and a flap gummer pad 120 carried by a flexible support member 122. The support member is attached to the gummer cylinder with adhesive members 124, 126, such as lengths of adhesive tape.

This embodiment of a wiper roll gear train 128 is depicted in FIG. 2 and includes a gum roller gear 130 and an associated hub 132. It will be understood that the gears can be removed and replaced in order to allow a change in the gear ratios and rotational speed of the rollers. Likewise, the rollers can be changed if desired or required. A wiper roller gear 134 and an associated hub 136 are eccentrically supported by structural support member 84 in this embodiment.

An intermediate gear 138 provides for the gum roller and the wiper roller to rotate in the same direction and opposite to the gummer cylinder. The intermediate gear includes an associated support shaft and hub combination 140.

Figure 4:
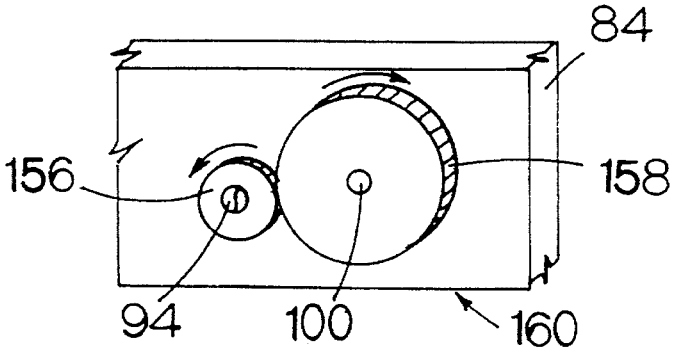
FIG. 4 is a schematic elevation view of another side of the apparatus depicting a schematic diagram of another gear train.

This embodiment, of a meter roll gear train 160 is depicted in FIG. 4 and includes a drive shaft gear 156 and a metering roller support shaft gear 158. The gear 158 can be removed and it and associated shaft 100 are eccentrically mounted to member 84 by a suitable hub member (not shown).

The metering roller 58 and the gum roller 60 rotate in the same direction to provide the desired skidding of the metering roller over the surface of the gum roller.

Figure 5:
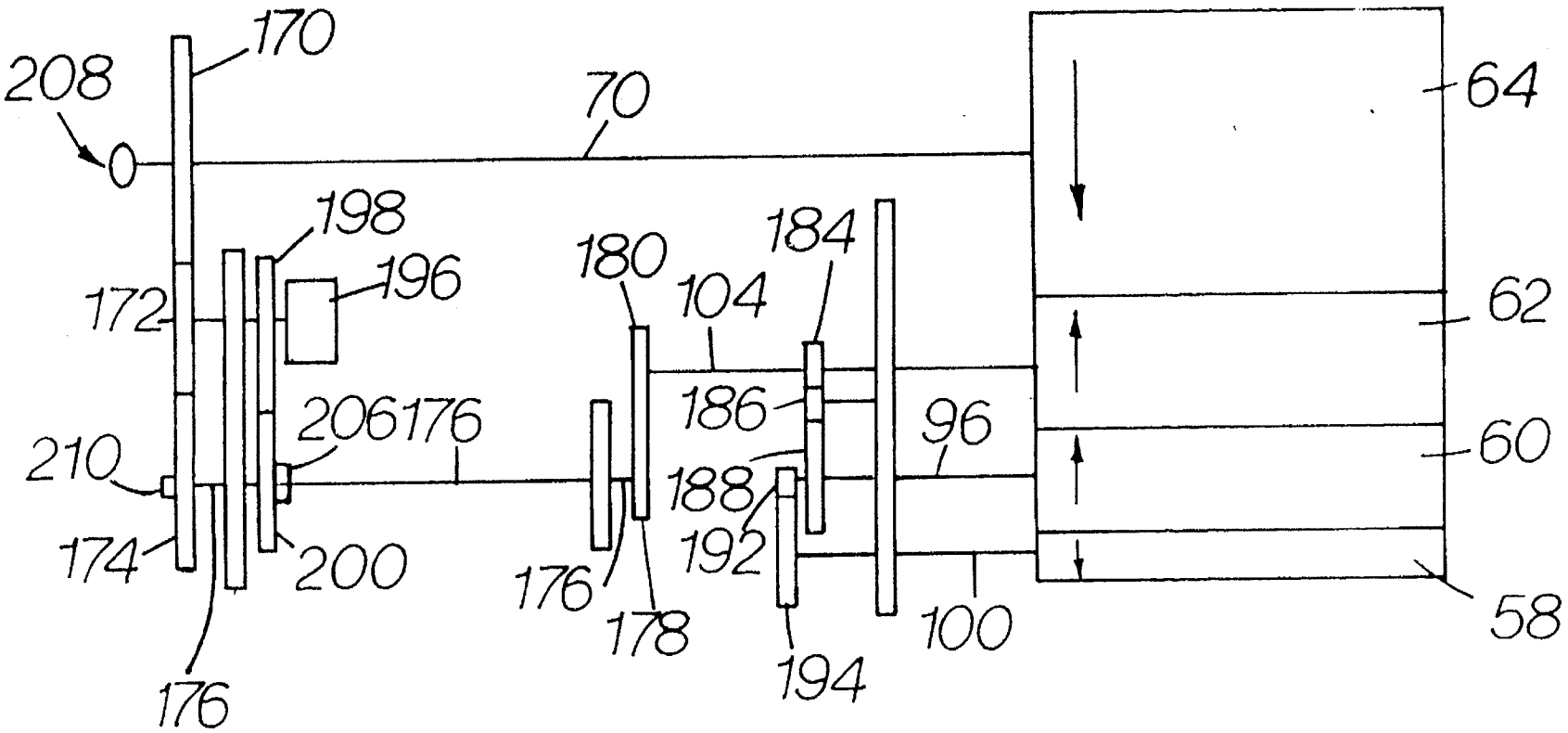
FIG. 5 is a diagram of one embodiment of a gear train incorporated in the present invention.
Figure 6:
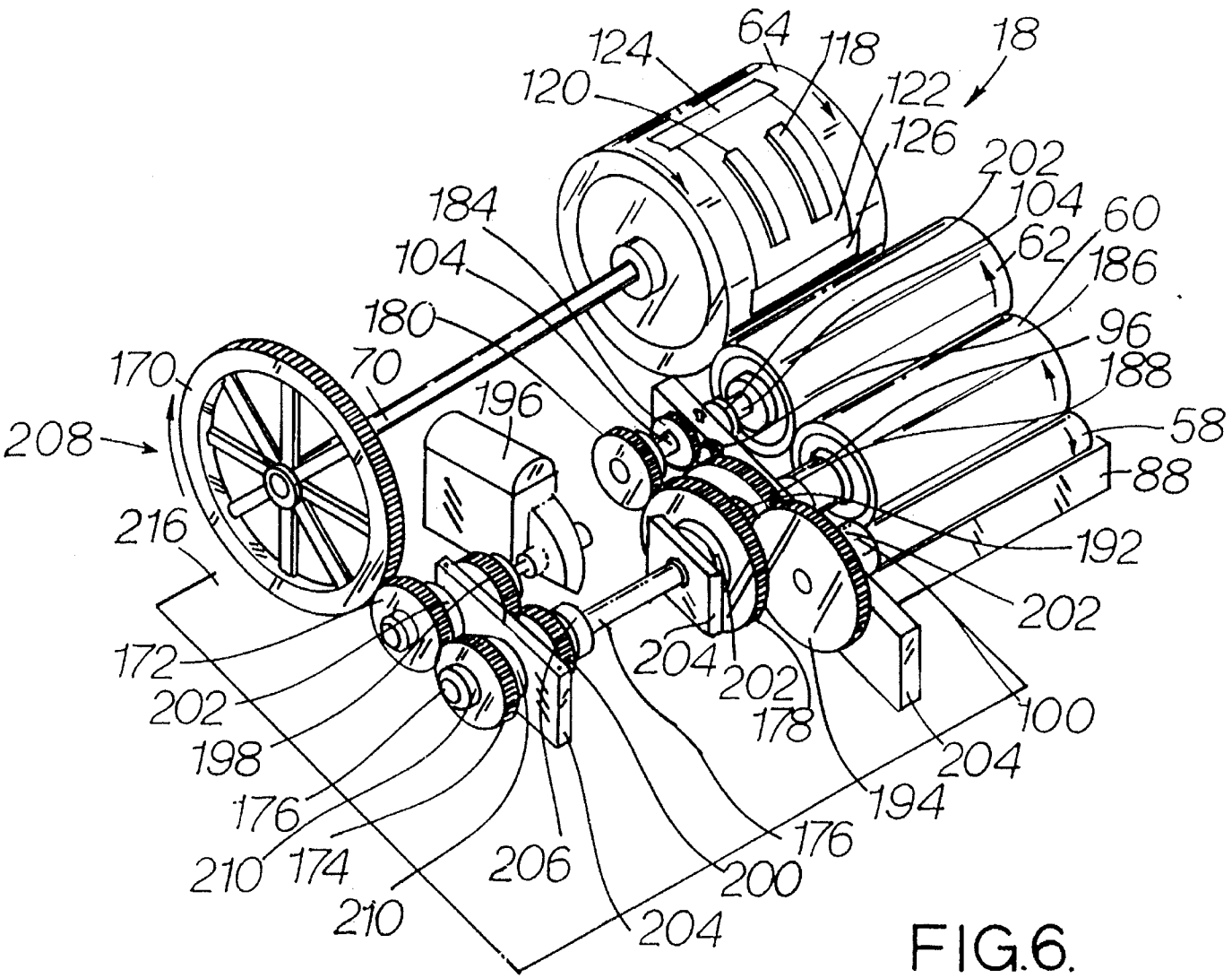
FIG. 6 is a perspective view showing one preferred embodiment of the gear train incorporated as part of the present invention.

Another preferred embodiment of the present invention includes a gear train for providing and transferring rotational motion to the rollers 58, 60, 62, and gummer cylinder 64 and is illustrated in FIGS. 5 and 6. The gear train provides a fixed relationship between the rotational speed and direction of the gum roller 60, metering roller 58 and the wiper roller 62. Incorporation of a clutch allows the rollers 58, 60, and 62 to continue rotating when the main power source is interrupted between full shut downs.

The gear train consists of a series of gears arranged such that rollers and cylinders operate in the same sense and relative speeds as set forth above. That is, the gum roller 60 rotates faster than and in an opposite rotational direction then the metering roller 58, and the wiper roller 62 rotates in the same rotational direction and at approximately twice the speed as the gum roller 60.

In the preferred embodiment illustrated in FIGS. 5 and 6, rotational energy is provided to the gummer roll apparatus 18 by either a power take off as previously described or by an electric motor 196 as an auxiliary drive means to a main drive means. The electric motor 196 operates to rotate drive gear 198 which in turn operates a gear 200. Gear 200 is mounted upon and turns shaft 176.

Shaft 176 in turn rotates gear 178 if gear 198 is driven by the motor 196. In this event a roller clutch arrangement generally identified as reference characters 206 and 210 pressed into the bores of gear 200 and gear 174 in the embodiment illustrated in FIGS. 5 and 6. In this arrangement shaft 176 is rotated by either gear 174 or gear 200, whichever gear is being driven. The clutch arrangement is partially supported by block 204 in the illustrated embodiment.

If the power take off or other drive arrangement generally indicated with reference character 208 is the power source then shaft 176 is rotated by gear 174, but not gear 200. If the motor is the power source, then shaft 176 is rotated by 200, and gear 174 does not rotate.

A roller bearing clutch 206 and 210 is pressed into the bore of each gear 200 and 174. When the outside surface of the roller bearing clutch is rotated in one direction, then roller bearings within the clutch lock onto the shaft and turn the shaft. Rotating the shaft associated with the roller bearing clutch in the same direction causes the associated roller bearing clutch to operate as only a rotational bearing.

When gear 170 is driving gear 172 and gear 174, the rotation of gear 170 locks the roller bearing clutch 210 onto the shaft 176 and rotates gear 178. This occurs with the motor 196 off. Gear 200 is not rotating and the roller bearing clutch 206 inside the bore of gear 200 is operating as a roller bearing due the direction of rotation of shaft 176.

In the event that the normal drive to shaft 170 stops, then the motor 196 is turned on thereby driving gear 200. Gear 200 drives the shaft 176 since gear 200 is now locked onto the shaft 176 by the roller bearing clutch 206. Gear 174 does not rotate since the roller bearing clutch 210 operates within gear 174 as a bearing when the shaft 176 is driven by gear 200.

If power is applied to gear 170 or shaft 70 then gear 170 drives an idler gear 172 which drives gear 174. The gear 170 is mounted on the shaft 70 which rotates the gummer cylinder 64 as previously described. It will be understood that the power could be applied to shaft 176 without deviating from the scope of the present invention.

Gear 178 on drive shaft 176 drives gear 180 mounted on shaft 104 to rotate the wiper roller 62. Gear 184, also mounted on shaft 104, drives another idler gear 186 which in turn drives gear 188 on shaft 96 to rotate the gum roller 60.

Gear 192, also mounted on the shaft 96, drives gear 194 mounted on shaft 100 and rotates the metering roller 58.

In one preferred embodiment the gears have the following diameters: gear 170 twelve inches, gears 172, 174, 178, 180 and 194 four and one half inches, gear 184 two inches, gear 188 four inches, gear 192 one and three-sixteenth, and idler gear 186 can be of any convenient diameter. This arrangement provides for the gum roller 60 to rotate at half the rotational speed of the wiper roller 62 and the metering roller 58 rotating 1 revolution to three and seventy nine one hundredths (3.79) revolutions of the gum roller 60.

In the preferred embodiment the gear 180 is the same diameter as the cylinder or applicator roller 64. Thus, if the cylinder 64 is changed, then it will be understood to change the gear 170 in order that the gear and the cylinder are the same diameter.

It will be understood that the gears may be changed in order to vary the gear ratios and effect a change of relative speeds of rotation as between the rollers and gumming cylinder, for example, between the gum roller and the metering roller, between the gum roller and wiper roller.

It will be further understood that each gear connects to its respective shaft by a conventional spline identified by reference character 202 in FIG. 6. Not all of the splines are shown in FIG. 6 due to a plurality of bearing support blocks 204 depicted in the drawing figure. Since FIG. 5 is the gear train diagram, the splines, bearings, and other supports are not shown.

FIG. 6 depicts gear 170 without a support member in order to illustrate the gear train. It will be understood that the gear may be supported from above if there is adjacent structure, or from below, for example by extending a suitable support up from the platform 216.

The blocks support the shafts and are in turn supported on a suitable platform 216 located underneath the drive and adjacent the gum box. The support platform may supported by the support structure shown dashed in FIG. 2. This is not shown in detail as it will be determined in part by the apparatus with which it used, and in part if the gum box is added to an existing piece of equipment or built into new equipment.

Figure 3:
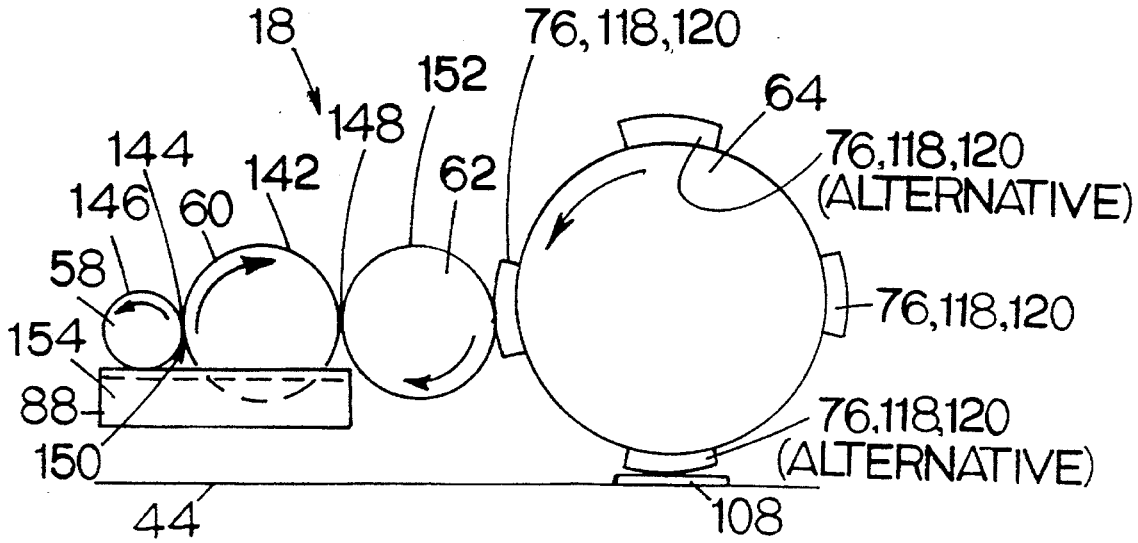
FIG. 3 is schematic elevation view of a gumming roller combination incorporating the wiping roll of this invention.

In operation, in connection with the gumming apparatus 10 previously mentioned, an adhesive carrying surface 142 of the gum roller 60 passes through the adhesive pan 88 and an adhesive 154 contained in the pan and carries a portion of the adhesive out of the pan as shown in FIG. 3. The metering roller 58 is provided or adjusted to give a desired gap 144, thereby returning excess adhesive to the pan. A surface 146 of the metering roller 58 skids across the gum roller at a desired distance and returns excess adhesive to the pan 88.

The excess adhesive returns to the pan 88 in what may be described as a waterfall of adhesive. In a preferred embodiment the meter roller is placed as near as possible to the surface of the adhesive 156. The closer to the surface of the adhesive, the less foaming and frothing that occurs. To better understand the foaming problem, typical latex adhesives are a white milky fluid that will foam when agitated much like an egg white when beaten. When adhesive foaming gets out of control it is typical that the foam and adhesive will overflow the pan 88.

A typical adhesive pan is approximately 1½" deep and the gum roll is placed within approximately ⅛" of the bottom of the pan 88. This should reduce foaming as the gum roller passes through the adhesive 156.

The meter roller 58 rotates in the opposite direction to provide relative movement in the same direction as the gum roller 60 and the metering roller 58 rotates slower than the gum roller 60 and skids across the gum roller surface returning the excess adhesive to the pan 88. The meter roller eccentric adjustment allows the optimum skidding effect. The optimum adjustment of the meter and gum rollers has been observed to produce a corduroy effect whereby the adhesive remaining on the gum roller produces a series of parallel grooves on the gum roller and around the circumference of the gum roller.

The wiper roller 62 rotates in the same direction as the gum roller 60. The present invention is intended to operate at roller speeds in excess of conventional rollers. In one embodiment the gum roller operates at a rotational speed of approximately 150 r.p.m. and a preferred gear train rotates the meter roll at approximately 38 r.p.m. and the wiper roll at approximately 300 r.p.m., while the gummer cylinder at approximately 150 r.p.m., that is the gummer pads rotate to match the speed of gummer roll 62 as they both rotate. Workpiece output is increased over the conventional gum box arrangement since with the diameter doubled the gummers 76, etc. operate on two workpieces for each cylinder rotation. The wiper roll transfers the adhesive to the gummer cylinder in the corduroy or corrugated pattern when optimally adjusted on its eccentric.

The motor 196 is intended as an auxiliary power source in order to maintain rotation of the rollers 62, 60, and 58 when the power source, power take off or the like (identified as reference character 208 in FIG. 5) is not operating. In this manner the rollers continue to rotate and maintain adhesive on the rollers. The rollers stay wet and the gumming station remains ready to operate as soon as the power 208 is restored or restarted. This is possible do to the use of a clutch arrangement 206 and 210 mounted relative to and within the gears 200 and 174, respectively.

In the event of power shut down, for example by pushing a stop button 212 at a power control panel, then a relay 218 associated with the stop button 212 initiates the starting of the motor 196 by energizing a start switch 214 associated with the motor 196. It will be desired to provide the switch 214 with a manual override to start and stop motor 196.

Figure 7:
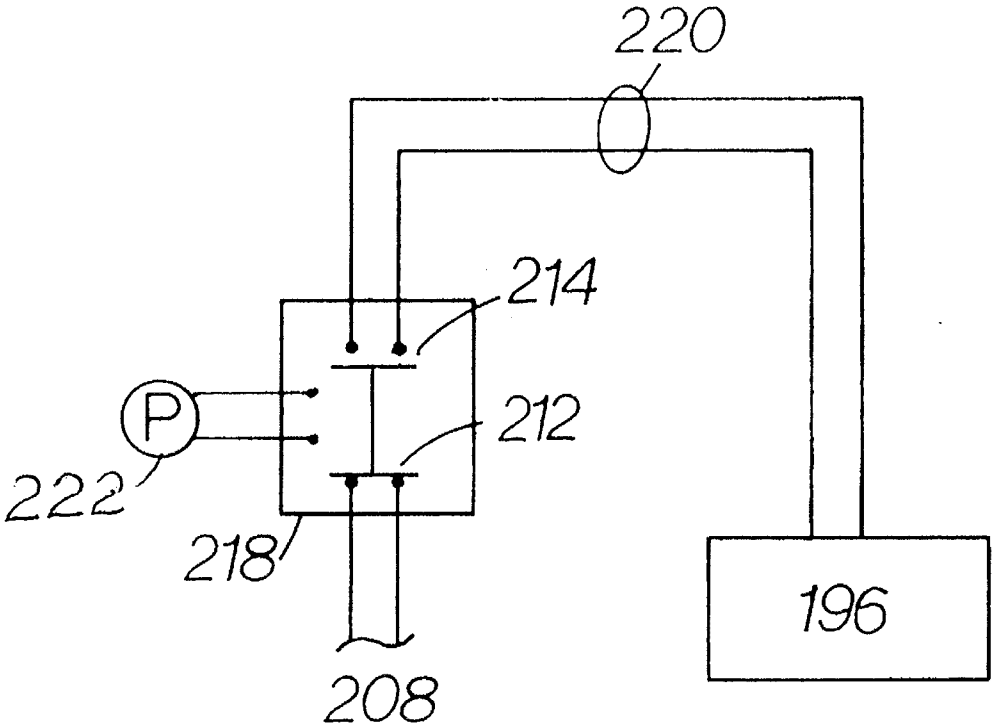
FIG. 7 is a schematic illustrating control of an auxiliary motor that maintains gummer roll rotation when the primary source of power is off.

The stop button 212, start switch 214, and the associated relay 218 can be provided in a number of combinations, including a normally open contact and a normally closed contact that will energize the start switch of motor 196 when power shut off. The relay 218 is connected to the motor 196 by suitable wiring 220, as shown in FIG. 7.

The power source 222 may be separate or protected to insure continued rotation and operation of the relay and motor in the case of a temporary power failure.

A clutch arrangement relative to gears 174 and 200 allows gear 200 to be driven without rotating gear 174 and gear 174 to be driven without rotating gear 200. Shaft 176 rotates in either case. Similarly, when power is supplied the rotation of gear 174 rotates shaft 176 and not gear 200 and, therefore, the other gears to rotate the gummer rolls 62, 60, and 58 as previously described.

The above applies as well to the embodiment depicted in FIGS. 5 and 6 with the appropriate changes in speeds to reflect a particular gear train, either as described herein for a preferred embodiment or as selected by one skilled in the art with the foregoing description as a guide to effect the present invention.

As previously stated, in a preferred embodiment for a particular gumming apparatus set up the roll 62 is 4 ½" in diameter and gears 172, 176, 178, 180 are same diameter as roll 62.

If it should be desired to change to 4" diameter gears, then the gears will be replaced with gears having an appropriate diameter to keep roller 62 in time with the gummer pads as they come around on the gumming cylinder in registration with the workpieces. Gears 172 and 180 would be 4" in diameter and gears 176 and 178 will be smaller or larger as long as they were both the same diameter.

From the foregoing description those skilled in the art will appreciate that all of the objects of the present invention are realized. A gummer roll apparatus has been shown and described for providing the desired application of a gum, adhesive, or the like to an envelope flap or another workpiece run through the apparatus. One embodiment of the gum roll apparatus includes a gear train for matching the speed of the cooperating rollers, including the gum box rolls and the roll applying the adhesive to the workpiece.

While specific embodiments have been shown and described, many variations are possible. The eccentric mounting of the gears and shafts is a preferred feature. However, since all of these members can be removed, then the desired adjustments can be accomplished by changing the gears and rollers. It will be understood that those skilled in the art have the ability to determine the desired roller diameters of eccentric adjustments to provide desired operation of this invention.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A method of transferring an adhesive, the method comprising the steps of:

providing adhesive in a container having a reservoir means;

rotating a first roller means through the adhesive in the container and collecting adhesive on the first roller means, the first roller means rotated in a first direction;

rotating a second roller means in a second direction of rotation;

skidding the second roller means against the first roller means, the first roller means and the second roller means rotating in opposite directions;

transferring a portion of the adhesive carried on the first roller means to the second roller means through the skidding contact between the rollers;

returning an excess portion of the adhesive to the adhesive means container;

rotating the first roller means and the second roller means in skidding contact, thereby returning the excess adhesive to the adhesive container without substantially foaming the adhesive prior to its return to the container;

transferring adhesive from the first roller means to a third roller means in operative contact with the adhesive carried on the first roller means;

rotating the third roller means in the first direction;

transferring adhesive from the third roller means to a fourth roller means in operative contact with the adhesive carried on the third roller means;

rotating the fourth roller means in the second direction; and driving at least the first and the second of the roller means with a gear train, thereby providing rotational motion to the rollers associated with the adhesive container.

2. A method of transferring an adhesive as set forth in claim 1, further comprising the step of:

wiping the first roller means and the second roller means as a result of the skidding contact so as to effectively returns excess adhesive into the reservoir means provided by the container and returning the adhesive with a minimum of foaming.

3. A method of transferring an adhesive as set forth in claim 1, further comprising the steps of:

rotating the second roller means relative to the first roller means;

skidding the second roller means relative to the first roller means;

metering the amount of adhesive transferred from the container means to the first roller means as a result of the skidding contact between the first roller means and the second roller means and returning an excess adhesive portion to the reservoir means; and driving the roller means with the gear train, thereby providing rotational motion.

4. A method of transferring an adhesive as set forth in claim 1, further comprising the steps of:

accumulating adhesive on the surface of the first roller means as the first roller means progresses through the reservoir means provided by the container;

rotating the second roller means in skidding contact with the first roller means;

skidding the first roller means in contact with the second roller means;

returning excess adhesive to the reservoir without substantial foaming of the adhesive in the adhesive reservoir as a result of the skidding contact between the first roller means and the second roller means; and driving the roller means with the gear train, thereby providing the roller means with rotational motion.

5. A method of transferring an adhesive as set forth in claim 4, further comprising the steps of:

rotating the first roller means faster than and in an opposite rotational direction relative to the second roller means;

rotating the third roller means in the same rotational direction and at approximately twice the speed as the first roller means with a main power source; and rotating all but the third roller by an auxiliary power source through the gear train.

6. A method of transferring an adhesive as set forth in claim 5, further comprising the step of:

changing at least one of the gear drive train gears, thereby allowing a plurality of gear ratios between the first roller means and second roller means and between the first roller means and third roller means to effectively change the relative speed of the roller means.

7. A method of transferring an adhesive as set forth in claim 1, further comprising the step of:

supplying the gear train with rotational motion with a drive motor auxiliary to a primary apparatus motor.

8. A method of transferring an adhesive as set forth in claim 7, further comprising the step of using the auxiliary drive motor when the primary power is off.

9. A method of transferring an adhesive as set forth in claim 8, further comprising the step of transferring power to the auxiliary motor in response to shutting off power to a main drive.

10. A method of transferring an adhesive, the method comprising the steps of:

providing an adhesive in a reservoir;

rotating a first roller in a first direction and in contact with the adhesive in the reservoir;

collecting adhesive on the first roller as it rotates through the adhesive in the reservoir;

rotating a second roller in a second direction, the second direction opposite to the direction of rotation of the first roller, the second roller moving at a speed less than the speed that the first roller is rotating, whereby excess adhesive is returned to the reservoir without creating substantial adhesive foaming in the reservoir;

rotating a third roller in the first direction;

contacting the rotating surface of the first roller and the third roller in order to provide for transfer of at least a portion of the adhesive on the surface of the first roller to the third roller;

transferring from the first roller to a second roller at least some of the adhesive remaining on the first roller;

transferring adhesive from the third roller means to a fourth roller means in operative contact with the adhesive carried on the third roller means;

rotating the fourth roller means in the second direction; and driving the first roller and the second roller with a gear train.

11. A method of transferring an adhesive as set forth in claim 10, further comprising the step of:

wiping the first roller and the second roller as a result of a relative skidding movement between the first roller and the second roller; and returning excess adhesive into the reservoir without substantial adhesive foaming.

12. A method of transferring an adhesive as set forth in claim 10, further comprising the step of rotating the third roller at approximately twice the speed of the first roller.

* * * * *